United States Patent [19]

March

[11] 4,173,284

[45] Nov. 6, 1979

[54] HINGED TRAY ASSEMBLY

[75] Inventor: Joseph E. March, Chicago, Ill.

[73] Assignee: Platt Luggage, Inc., Chicago, Ill.

[21] Appl. No.: 889,341

[22] Filed: Mar. 23, 1978

[51] Int. Cl.[2] ..... B65D 83/00; A47B 51/00

[52] U.S. Cl. ..... 206/349; 190/17; 211/128; 312/DIG. 33

[58] Field of Search ..... 206/349; 190/17; 211/81, 85, 128; 312/DIG. 33, 271, 272, 273

[56] References Cited

U.S. PATENT DOCUMENTS

| | | | |
|---|---|---|---|
| 722,771 | 3/1903 | Taylor | 190/17 |
| 771,572 | 10/1904 | Plummer | 190/17 |
| 814,572 | 3/1906 | Thilborger et al. | 190/17 |
| 841,813 | 1/1907 | Plummer | 190/17 |
| 884,428 | 4/1908 | Strong | 190/17 |
| 1,169,638 | 1/1916 | Hammond | 190/17 |
| 3,612,635 | 10/1971 | Uyeda | 312/272 |

FOREIGN PATENT DOCUMENTS

| | | | |
|---|---|---|---|
| 268901 | 3/1966 | Australia | 312/DIG. 33 |
| 1557875 | 1/1968 | France | 190/17 |
| 209589 | 1/1924 | United Kingdom | 190/17 |

*Primary Examiner*—Herbert F. Ross

*Attorney, Agent, or Firm*—Fitch, Even & Tabin

[57] ABSTRACT

A supply carrier for removable insertion into a tool case includes a plurality of trays. The trays are generally identical in shape and dimensions. Each tray includes a generally rectangular base and an upstanding flange which includes at least a first side wall and a second side wall spaced from and generally parallel to the first side wall. The trays are connected by a pair of link members pivotally attached to the first side walls and a generally identical pair of link members pivotally attached to the second side walls. The trays are pivotable between a first position of vertical alignment, a second position of supported offset arrangement and a third position of supported horizontal alignment.

9 Claims, 4 Drawing Figures

HINGED TRAY ASSEMBLY

The present invention relates to tool cases. More particularly, it relates to a plurality of trays linked to one another such that the trays are vertically alignable for removable insertion into a tool case and are pivotable to a supported position of horizontal alignment and to a supported position of offset arrangement.

In the field of tool cases, it is generally desirable to transport a large number of tools and supplies within a condensed volume. However, upon arrival at the area of the work site, it is undesirable to search through the tool case in order to find a particular tool or supply. Also, in many cases, the workman is confined to a relatively small work area which does not accommodate the dimensions of a complete tool case and which is frequently remote from an area which can accommodate the complete tool case. Consequently, carriers have been provided for removable insertion into tool cases. For example, some carriers comprise generally planar boards having individual slots or holders for receiving tools, such as the implement holders discussed in Patent No. 3,880,285. Such removable carriers are satisfactory for hand tools such as hammers, pliers, brushes, etc., each of which is relatively large in size compared to a carrier. However, such carriers are not satisfactory for smaller supplies such as screws, nails, solder, etc. Consequently, boxes of supplies are generally stacked within a single compartment of the tool case. Employing such a storage compartment, each time a workman desires a particular supply, he must return to the tool case and search through the supply compartment until he locates the desired supply. Such a procedure is unreasonably time-consuming.

A single removable compartment overcomes the time losses inherent in such trips between the remote work site and the tool case. However, the workman continues searching through the compartment for the desired supply, unless the compartment is shallow, in which case not many supplies can be carried.

Although there have been several prior tray carriers which can be placed in a compact arrangement for transportation, and then expanded to permit access or viewing of each tray, these prior tray carriers suffer a number of deficiencies, particularly relating to their incapacity for adaption to the requirements of a work site. For example, the trays have had only one supported position other than the vertical arrangement. That is to say, the prior tray carriers are not adaptable to both a horizontal surface, such as a floor, and a sloping surface, such as a roof. Also, the linking means have been quite complex where more than two trays have been attached, frequently requiring several differently sized or shaped link members. Furthermore, none of the prior tray carriers have been removably insertable within a tool case for compact storage and transportation.

It is therefore an object of the present invention to provide a carrier for transporting supplies from a tool case to a remote work site.

It is also an object to provide a single carrier which includes a plurality of trays.

It is a further object to provide integral means for linking three or more trays for pivotal relative motion between a position of vertical alignment, a supported position of horizontal alignment and a supported position of offset arrangement.

These and other objects and advantages of the invention will become apparent from the following detailed description and from the accompanying drawings, in which.

Figure 1:
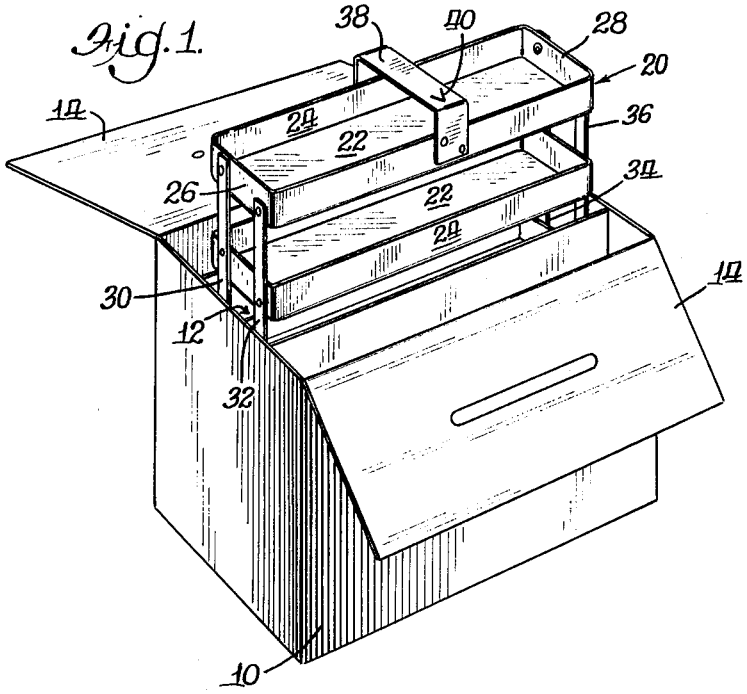
FIG. 1 is a perspective view of an open tool case and a partially withdrawn carrier embodying various of the features of the present invention.
Figure 2:
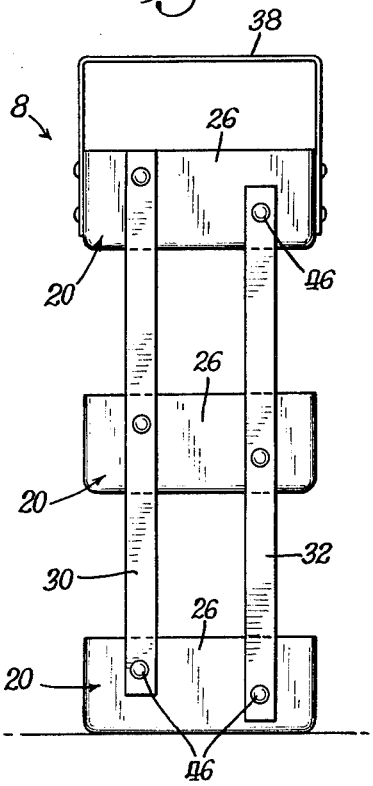
FIG. 2 is a plan view of a carrier in a first position, and embodying various of the features of the present invention.
Figure 3:
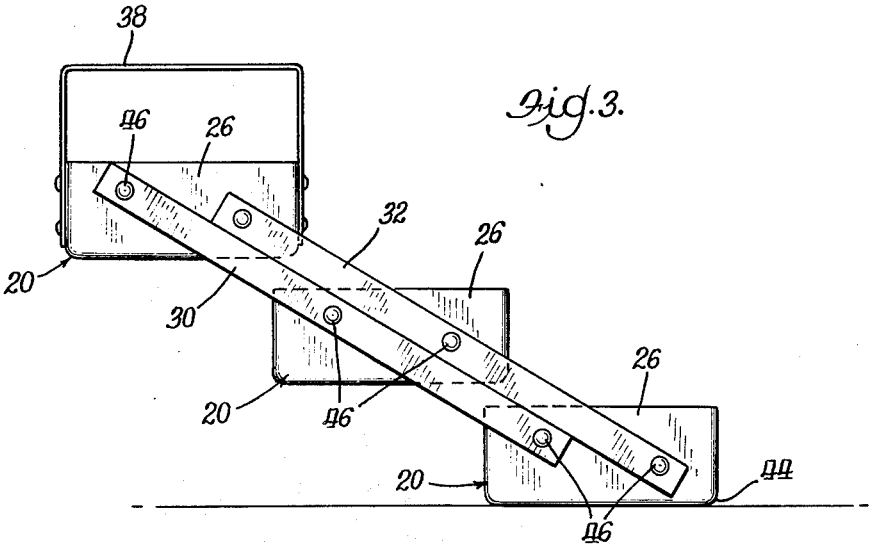
FIG. 3 is a plan view of the carrier shown in FIG. 2, and in a second position.
Figure 4:
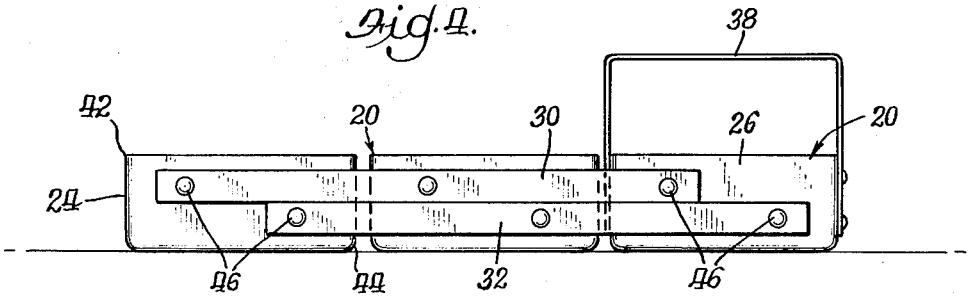
FIG. 4 is a plan view of the carrier shown in FIG. 2, and in a third position.

Generally, a carrier 8 is provided for removable insertion into a tool case comprising a box 10 defining a compartment 12, cover means 14 for selectively closing the box 10. The compartment 12 is adapted to slidably receive the carrier 8 which includes a plurality of trays 20 interconnected by link means which are attached to each of the trays 20 by pivotal attaching means. The link means permit the trays 20 to be moved relative to one another between a first position of vertical alignment, a second position of offset progression and a third position of horizontal alignment.

Referring more particularly to the drawings, a carrier 8 includes a plurality of trays 20, generally identical in shape and dimensions. Each tray 20 includes a generally rectangular base 22 and an upstanding flange 24 extending substantially around the periphery of the base 22. The flange 24 provides at least a first side wall 26, and a second side wall 28 spaced from and generally parallel to the first side wall 26.

The plurality of trays 20 are connected by link means comprising a pair of generally parallel link members 30 and 32 pivotally attached to the side wall 26 of each tray 20 and a generally identical pair of generally parallel link members 34 and 36 pivotally attached to the second side wall 28 of each tray 20. The link members 30, 32, 34 and 36 are generally identical, each being generally constant in width. The points of attachment for each of the trays are located in generally identical positions relative to one another and to the base.

The distance between the points of attachment of each of the link members 30, 32, 34 and 36 to the side walls 26 and 28 of each pair of adjacent trays 20 is generally identical and greater than the maximum cross-sectional dimension of the generally identical trays 20. The link members 30, 32, 34 and 36 are generally parallel to one another regardless of the relative positions of the trays 20. The points of pivotal attachment of the pairs of link members 30 and 32, 34 and 36 to each of the side walls 26 and 28 are vertically spaced by a distance approximately equal to the width of the link members and laterally spaced by a distance approximately equal to one half of the distance between the points of pivotal attachment of each link member to two adjacent trays.

When the trays are in the second position, in which the trays are progressively offset in step-wise relationship, the link members 30, 32, 34 and 36 are generally oblique to the planes defined by the bases 22 and the link members of each link member pair are in bearing engagement with one another.

When the trays 20 are in the third position, in which the trays are horizontally aligned and the bases 22 are generally coplanar, the link members 30, 32, 34 and 36 are generally parallel to the plane defined by the bases 22 and the link members of each link member pair are in bearing engagement with one another.

A rigid handle 38 is fixedly attached to the tray 20 which occupies the uppermost position when the carrier is in the first position. The handle 38 permits easy insertion and removal of the carrier from a tool case by permitting the operator to avoid contact with the walls of the tool case. Also, the handle provides means for grasping the carrier when it is transported separately from the tool case. A directing mark 40 is preferably included on the handle 38 to indicate the direction of pivotal motion which carries the trays to the third position of horizontal alignment.

The trays 20 and the link members 30, 32, 34 and 36, and the handle 38 are composed of a lightweight and rigid material such as molded vinyl resin or polystyrene.

In one embodiment, each base 22 is approximately 44 centimeters in length and 9 centimeters in width. The flange 24, which extends around the entire periphery of the base 22, extends perpendicularly upwardly from the base 22 by a distance of about 4 centimeters. The maximum cross-sectional dimension, measured between an upper corner 42 and a lower corner 44 of a first side wall 26, is about 9.8 centimeters. Each link member is generally linear, about 22.5 centimeters in length and about 1.5 centimeters in width. The link members are snugly attached to each tray by means of pivotal rivets 46 such that the weight of an empty tray alone does not exert sufficient force to cause pivotal motion about the rivets.

The points of pivotal attachment of each link member 30, 32, 34 or 36 to a pair of adjacent trays 20 are spaced apart by a distance of about 10 centimeters, which is greater than the maximum cross-sectional dimension of about 9.8 centimeters. The points of pivotal attachment of each first link member 30 and 34 are vertically spaced from the points of pivotal attachment of each second link member 32 and 36, respectively, by a distance of about 1.5 centimeters. The points of pivotal attachment of the first link members 30 and 34 to each tray 20 are laterally spaced by a distance of about 5 centimeters from the points of pivotal attachment of the second link members 32 and 36, respectively, to the same tray 20. The angles formed by the link members 30, 32, 34 and 36 and the planes defined by the bases 22, when the carrier is in the second position, are approximately equal to 30°.

In use, the carrier trays 20 are filled with supplies and placed in the first position of vertical alignment in which the link members 30, 32, 34 and 36 are generally perpendicular to the planes defined by the tray bases 22. The carrier 8 is slidably inserted into the compartment 12 of the tool case for storage or transportation. At a later time or different location, the supplies are jointly transportable to a work site remote from the tool case by slidably removing the carrier 8 from the tool case.

If the work site presents a sloping work surface, such as a roof, the trays 20 are pivoted to the second position in which they are supported by the bearing relationship of the link member pairs. Alternatively, if the work surface is generally level, the trays 20 are pivoted to the third position in which they are supported by the bearing relationship of the link member pairs. Thus, even if a portion of the carrier becomes unsupported by the work surface such as by hanging over an edge, the trays remain generally coplanar.

As a further alternative, if the work site is especially limited with regard to space, the trays 20 are maintained in the first position in which the spacing between trays permits accesss to all of the trays. Thus, regardless of the relative positions of the trays, the workman has access to the contents of all of the trays.

The present invention provides a carrier for transporting supplies in a plurality of linked trays. The trays are pivotable between a first position in which the trays are vertically aligned and a second position in which the trays are progressively offset and a third position in which the trays are horizontally aligned.

When the trays are in either the second or third position, the trays are supported in a stable position because the link members of each link member pair are in bearing relation to one another. Further pivotal motion of the trays is prohibited and the trays must be lifted in order to return them to the first position.

Various of the features of the present invention are set forth in the following claims.

What is claimed is:

1. A carrier comprising a plurality of trays generally identical in shape and dimensions, link means and means pivotally attaching said link means to said trays to permit pivotal relative motion of said trays between a vertically aligned first position in which said trays are vertically aligned, a second supported position in which said trays are progressively offset in a step-wise relationship, and a third supported position in which said trays are horizontally aligned, each of said trays comprising a generally rectangular base and an upstanding flange extending from said base, said flange including a first side wall and a second side wall spaced from and generally parallel to said first side wall, said link means comprising a first pair of link members pivotally attached to the first side wall of each tray and a second pair of link members, generally identical to said first pair of link members, pivotally attached to the second side wall of each tray, each pair of said link members comprising an elongated single first link member of generally constant width and an elongated second single link member of generally constant width, each of said link members being pivotally attached to each of said trays by said pivotal attaching means, the points of pivotal attachment of each link member to each pair of adjacent trays being spaced by a distance greater than the maximum cross-sectional width dimension of each tray, such that all of said link members are generally perpendicular to the planes defined by said bases when said trays are in said first position, such that all of said link members are oblique to the planes defined by said bases when said trays are in said second position, and such that all of said link members are generally parallel to the planes defined by said bases when said trays are in said third position.

2. A carrier in accordance with claim 1 in which said pivotal attachment means comprises pivotal rivets.

3. A carrier in accordance with claim 1 in which the link members forming each of the pairs of link members are in bearing engagement when said trays are in said second position.

4. A carrier in accordance with claim 1 in which the link members forming each of the pairs of link members are in bearing engagement when said trays are in said third position.

5. A carrier in accordance with claim 1 in which the carrier includes at least three trays.

6. A carrier in accordance with claim 1 in which a rigid handle is fixedly attached to said carrier.

7. A carrier in accordance with claim 1 in which the points of pivotal attachment for each side wall are vertically spaced by a distance approximately equal to the width of the link members.

8. A carrier in accordance with claim 7 in which the points of pivotal attachment for each side wall are laterally spaced by a distance approximately equal to one half of the distance between the points of pivotal attachment of each link member to two adjacent trays.

9. A tool case comprising a box defining a compartment, cover means, a carrier in accordance with claim 1 removably received within said compartment, and handle means on said carrier.

* * * * *